US007518555B2

(12) United States Patent
Heng et al.

(10) Patent No.: US 7,518,555 B2
(45) Date of Patent: Apr. 14, 2009

(54) MULTI-BAND ANTENNA STRUCTURE

(75) Inventors: Chew Chwee Heng, Singapore (SG); Yung Chang Wei, Sijihih (TW)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 11/497,240

(22) Filed: Aug. 2, 2006

(65) Prior Publication Data

US 2007/0030200 A1 Feb. 8, 2007

Related U.S. Application Data

(60) Provisional application No. 60/705,178, filed on Aug. 4, 2005.

(51) Int. Cl.
*H01Q 1/38* (2006.01)

(52) U.S. Cl. ..... 343/700 MS; 343/702

(58) Field of Classification Search ..... 343/700 MS, 343/702, 846, 848
See application file for complete search history.

(56) References Cited

U.S. PATENT DOCUMENTS 6,812,892 B2 11/2004 Tai et al.
7,050,010 B2 5/2006 Wang et al.
2003/0234742 A1* 12/2003 Tai et al. ..... 343/700 MS
2004/0108957 A1 6/2004 Umehara et al.
2004/0113848 A1* 6/2004 Gaucher et al. ..... 343/702
2005/0110692 A1* 5/2005 Andersson ..... 343/702

* cited by examiner

*Primary Examiner*—HoangAnh T Le
(74) *Attorney, Agent, or Firm*—Blank Rome LLP

(57) ABSTRACT

A multi-band antenna structure includes a ground plane, a first radiation metal arm, a first shorted parasitic arm and a second shorted parasitic arm. The first radiation metal arm is connected to a main transmitting antenna and has a first feed point for connecting a first feed line. The first shorted parasitic arm extends to the outside from the ground plane. The first shorted parasitic arm is between the first radiation metal arm and the ground plane for resonantly coupling the first radiation metal arm at a first band. The second shorted parasitic arm also extends to the outside from the ground plane. The second shorted parasitic arm is between the first radiation metal arm and the first shorted parasitic arm for resonantly coupling the first radiation metal arm at a second band.

8 Claims, 4 Drawing Sheets

MULTI-BAND ANTENNA STRUCTURE

CROSS-REFERENCE TO RELATED APPLICATIONS

This application claims priority from and is related to U.S. Provisional Application No. 60/705,178 filed Aug. 4, 2005. This prior application, including the entire written description and drawing figures, is hereby incorporated into the present application by reference.

BACKGROUND OF THE INVENTION

1. Field of the Invention

The present invention relates to the structure of an antenna, more specifically the structure of a multi-band antenna. More particularly, to a multi-band antenna that utilizes a shorted parasitic arm to achieve operating multi-bands.

2. Background of the Related Art

As wireless network technology has developed, a wireless network is utilized to perform network browsing, data transmission, transactions, educations and email transmitting/receiving, so that wireless networking has become an important tool for computer users. Meanwhile, various communication protocols and techniques have been developed for the wireless network technology such as Wireless Local Area Network (WLAN), Global System for Mobile Communications (GSM), General Packet Radio Service (GPRS), Code-Division Multiple Access (CDMA) and Wideband Code Division Multiple Access (WCDMA). The aforesaid technologies are used in the transmission media for wireless networks.

However, a basic transmission component for wireless transmission technology still relies upon an antenna to achieve transmitting. The design of the antenna influences the transmission quality of wireless signals. In order for a user to make connections with the wireless networks, the antenna should be capable of operating in multiple modes and still have a small "footprint," so that it can be utilized in mobile computing devices. Therefore, there is a need in the prior art for a multi-band antenna structure that can satisfy the criteria discussed above.

SUMMARY OF THE INVENTION

Accordingly, one object of the present invention is to provide a multi-band antenna structure. A shorted parasitic arm is utilized to achieve the operating of the antenna in multiple bands.

The multi-band antenna structure disclosed by the present invention includes a ground plane, a first radiation metal arm, a first shorted parasitic arm and a second shorted parasitic arm. The first radiation metal arm is taken into a main transmitting antenna and has a first feed point for connecting a first feed line. The first shorted parasitic arm is a metal arm which extends to the outside from the ground plane. The first shorted parasitic arm is between the ground plane and the first radiation metal arm and is for resonantly coupling the first radiation metal arm at a first band. The second shorted parasitic arm is also a metal arm which extends to the outside from the ground plane. The second shorted parasitic arm is between the first radiation metal arm and the first shorted parasitic arm for resonantly coupling the first radiation metal arm at a second band.

These and other objects of the invention, as well as many of the intended advantages thereof, will become more readily apparent when reference is made to the following description, taken in conjunction with the accompanying drawings.

BRIEF DESCRIPTION OF THE FIGURES

The accompanying drawings are not intended to be drawn to scale. In the drawings, each identical or nearly identical component that is illustrated in various figures is represented by a like numeral. For purposes of clarity, not every component may be labeled in every drawing.

DETAILED DESCRIPTION OF THE PREFERRED EMBODIMENTS

Figure 1:
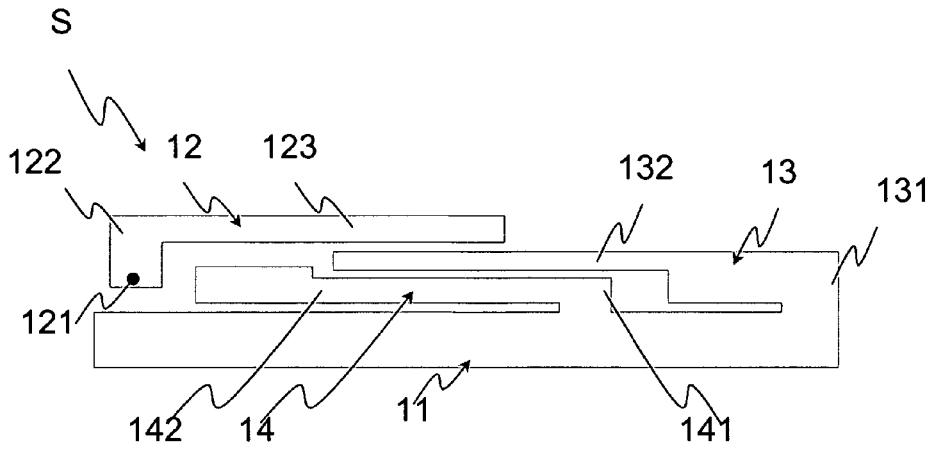
FIG. 1 is a schematic diagram illustrating a multi-band antenna structure according to an embodiment of the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents that operate in similar manner to accomplish a similar purpose.

Referring to FIG. 1, a schematic diagram illustrates a multi-band antenna structure according to an embodiment of the present invention. The multi-band antenna structure S includes a ground plane 11, a first radiation metal arm 12, a first shorted parasitic arm 13 and a second shorted parasitic arm 14.

The first radiation metal arm 12 is connected to a main transmitting antenna and has a first feed point 121 for connecting to a first feed line. The first radiation metal arm 12 is an L-type radiation metal arm. A radiation metal arm section 122 of the first radiation metal arm 12 is perpendicular to the ground plane 11. The radiation metal arm section 122 has an end point, which is near the ground plane 11 and has the first feed point 121. Another radiation metal arm section 123, which parallels the ground plane 11, is connected to another end of the radiation metal arm 12 relative to the ground plane 11.

The first shorted parasitic arm 13 extends to the outside from the ground plane 11 and is for resonantly coupling the first radiation metal plate 12 to a first band. The first shorted parasitic arm 13 can be an L-type metal arm. An end of a metal arm 131 of the first shorted parasitic arm 13 is connected to the ground plane 11.

The end of the metal arm 131 is perpendicular to the ground plane 11. Another end of the metal arm 131 is connected to another metal arm 132 which parallels the ground plane 11. The metal arm 132 is between the first radiation metal arm 12 and the ground plane 11.

The second shorted parasitic arm 14 extends to the outside from the ground plane 11 and is for resonantly coupling the first radiation metal arm 12 at a second band. The second shorted parasitic arm 14 can be an L-type metal arm. An end of a metal arm 141 of the second shorted parasitic arm 14 is connected to the ground plane 11. The end of the metal arm 141 is perpendicular to the ground plane 11. Another end of the metal arm 141 is connected to another metal arm 142 which parallels the ground plane 11. The metal arm 142 is between the first shorted parasitic arm 13 and the ground plane 11.

The first feed line may be a coaxial transmission wire. An outer ground conductor, wrapping the coaxial transmission wire, may be connected to the ground plane. In addition, in one embodiment, the first shorted parasitic arm 13 is resonantly coupled to the first radiation metal arm 12 at the first band as between 824 megahertz (MHz) and 960 MHz. The second shorted parasitic arm 14, according to one embodiment, is resonantly coupled to the first radiation metal arm 12 at the second band as between 1575 MHz and 2170 MHz. The multi-band antenna structure S can be used for wireless communication bands like Global System for Mobile Communication (GSM) 850, GSM 900, DCS 1800, Personal Communication System (PCS) 1900, Global Positioning System (GPS) and Universal Mobile Telecommunication System (UMTS).

Figure 2:
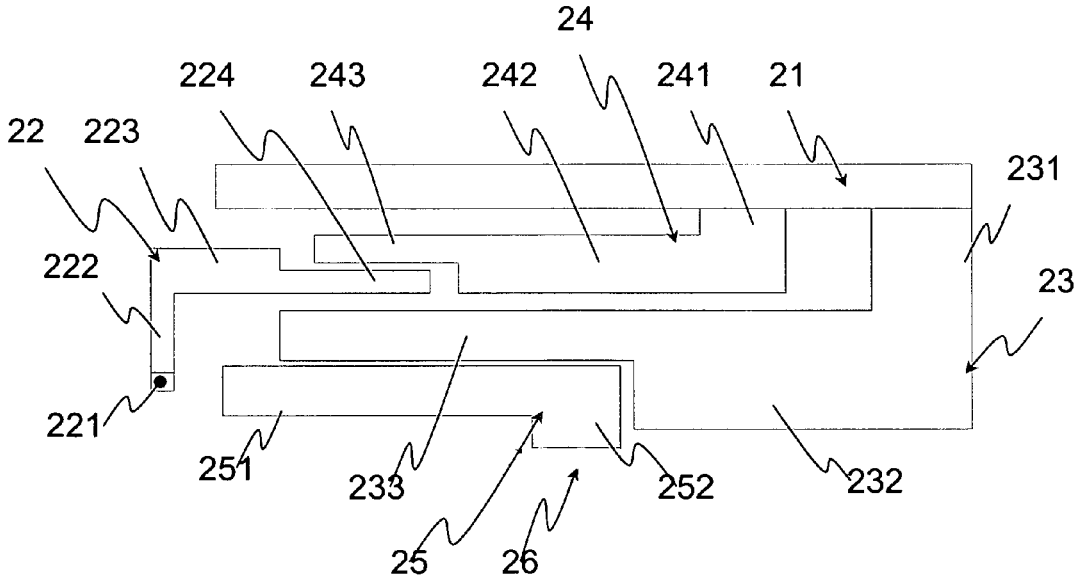
FIG. 2 is a schematic diagram illustrating multi-band antenna structure according to another embodiment of the present invention.

Referring to FIG. 2, a schematic diagram illustrates a multi-band antenna structure according to another embodiment of the present invention. The multi-band antenna structure includes a ground plane 21, a first radiation metal arm 22, a first shorted parasitic arm 23, a second shorted parasitic arm 24 and a third shorted parasitic arm 25.

The first radiation metal arm 22 is taken into a main transmitting antenna and has a first feed point 221 for connecting to a first feed line. The first radiation metal arm 22 is an L-type radiation metal arm. A radiation metal arm section 222 of the first radiation metal arm 22 is perpendicular to the ground plane 21. The radiation metal arm section 222 has an end point, where the end point is not near the ground plane 21 is the first feed point 221. Another radiation metal arm section 223 parallels the ground plane 21 and is connected to another end of the radiation metal arm section 222 relative to the ground plane 21. The width of a last end 224 extended from the radiation metal arm section 223 is smaller than the width of the radiation metal arm section 223.

The first shorted parasitic arm 23 extends to the outside from the ground plane 21 and is for resonantly coupling the first radiation metal arm 22 at a first band. The first shorted parasitic arm 23 can be an L-type metal arm. An end of a metal arm section 231 of the first shorted parasitic arm 23 is connected to the ground plane 21. The end of the metal arm section 231 is perpendicular to the ground plane 21. Another end of the arm, metal arm section 231 is connected to another metal arm section 232 which parallels the ground plane 21. The width of a last end 233 extended from the radiation metal arm section 232 is smaller than the width of the radiation metal arm section 232. The first radiation metal arm 22 is disposed near a side of the last end section 233. The radiation metal arm section 223 of the first radiation metal arm 22 parallels the ground plane 21 and the metal arm section 232.

The second shorted parasitic arm 24 extends to the outside from the ground plane 21 and is for resonantly coupling the first radiation metal arm 22 at a second band. The second shorted parasitic arm 24 can be an L-type metal arm. An end of the metal arm, metal arm section 241 of the second shorted parasitic arm 24 is connected to the ground plane 21. The end of the metal arm section 241 is perpendicular to the ground plane 21. Another end of the metal arm section 241 is connected to another metal arm section 242 which parallels the ground plane 21. The width of a last end section 243 extended from the radiation metal arm section 242 is smaller than the width of the radiation metal arm section 242. The last end 243 is between the first radiation metal arm 22 and the ground plane 21.

The third shorted parasitic arm 25 is another shorted parasitic arm. The third shorted parasitic arm 25 extends to the outside from the ground plane 26 and is for resonantly coupling the first radiation metal arm 22 at the second band. The third shorted parasitic arm 25 can be an L-type metal arm. The third shorted parasitic arm 25 relative to the first radiation metal arm 22 and ground plane 21 is disposed at another side of the first shorted parasitic arm 23. A metal arm section 251 of the third shorted parasitic arm 25 parallels the metal arm section 232 of the first shorted parasitic arm 23. Another metal arm section 252 is perpendicular and is not near the ground plane 21. A last end of the metal arm section 252 is connected to another ground plane 26.

The first feed line may be connected through a coaxial transmission wire. An outer ground conductor wrapped around the coaxial transmission wire may be connected to the ground plane. In addition, the first shorted parasitic arm 23 is resonantly coupled to the first radiation metal arm 22 at the first band as between 824 MHz and 960 MHz, according to one embodiment. The second shorted parasitic arm 24 and the third shorted parasitic arm 25 are resonantly coupled to the first radiation metal arm 22 at the second band as between 1710 MHz and 2170 MHz, according to a particular embodiment.

Figure 3:
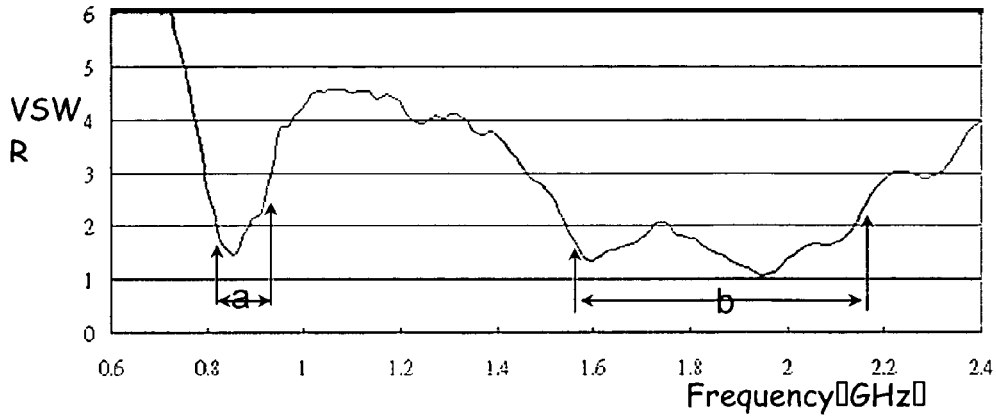
FIG. 3 is a graph illustrating performance measurement of Voltage Standing Wave Ratio (VSWR) for a multi-band antenna structure according to an embodiment of the present invention.

Referring to FIG. 3, a graph illustrates performance measurement of Voltage Standing Wave Ratio (VSWR) for a multi-band antenna structure according to an embodiment of the present invention. The VSWRs for band a from 824 MHz to 960 MHz and band b from 1575 MHz to 2170 MHz are minimums. Hence the bands could cover GSM850, GSM 900, DCS 1800, PCS 1900, GPS and UMTS, and there are good antenna radiation gains.

Figure 4:
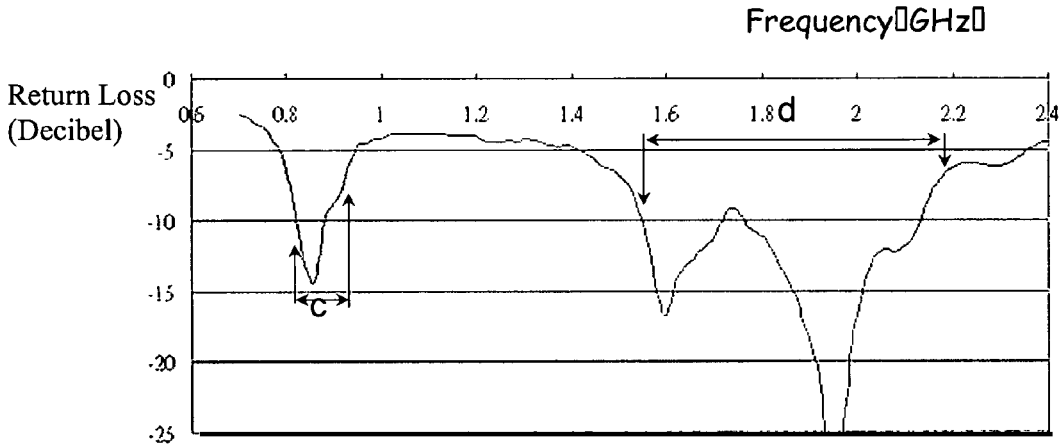
FIG. 4 is a graph illustrating the input impedance measurement for a multi-band antenna structure according to an embodiment of the present invention.

Referring to FIG. 4, a graph illustrates the input impedance measurement for a multi-band antenna structure according to an embodiment of the present invention. To observe the return loss as shown in the curve diagram, the band c from 824 MHz to 960 MHz and the band d from 1575 MHz to 2170 MHz are good operation bands.

Figure 5:
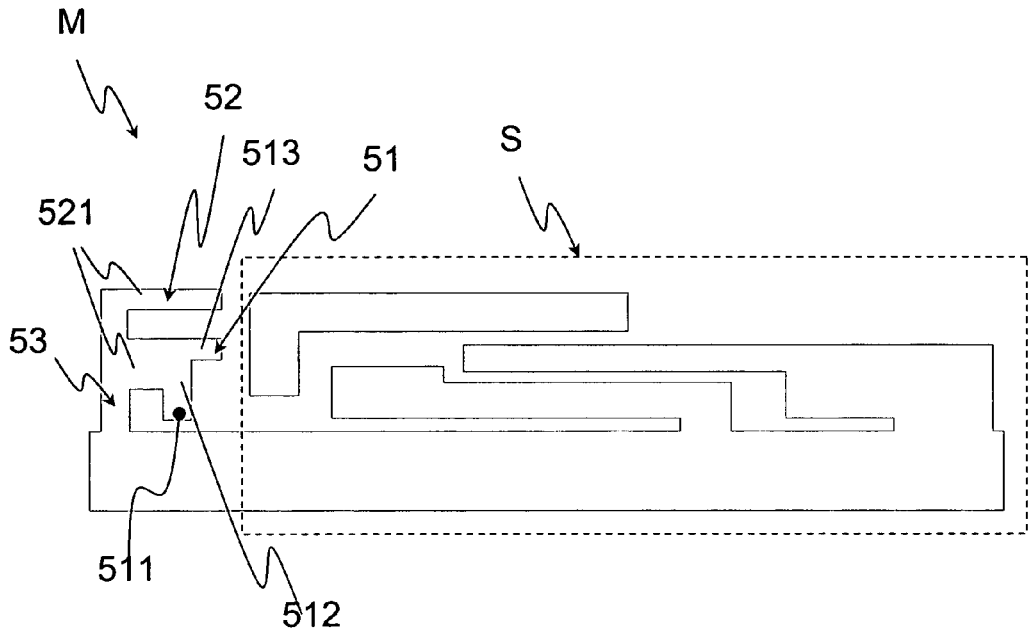
FIG. 5 is a schematic diagram illustrating a multi-band antenna structure according to a further embodiment of the present invention.

Referring to FIG. 5, a schematic diagram illustrates a multi-band antenna structure according to a further embodiment of the present invention. A second radiation metal arm 51, a third radiation metal arm 52 and a shorted parasitic arm 53 are disposed near the first radiation metal arm 12 of the multi-band antenna structure S as shown in FIG. 1.

The second radiation metal arm 51 resonates at a third band and has a second feed point 511 for connecting a second feed line. The second radiation metal arm 51 is an L-type radiation metal arm. A radiation metal arm section 512 which is perpendicular to the ground plane 11 has an end point. The end point which is near the ground plane 11 is the second feed point 511. Another radiation metal arm section 513 which parallels the ground plane 11 is connected to another end of the radiation metal arm section 512 relative to the ground plane 11.

The third radiation metal arm 52 resonates at a fourth band and extends from the second radiation metal arm 51 which is near the second feed point 511. The third radiation metal arm 52 is a specific-type radiation metal arm. One of two parallel radiation metal arm sections 521 is for connecting the second radiation metal arm 51 and parallels the ground plane 11.

The second radiation metal arm 51 and the third radiation metal arm 52 are connected to the ground plane 11 through the shorted parasitic arm 53 which extends perpendicularly to the third radiation metal arm 52.

The second feed line may be a coaxial transmission wire. An outer ground conductor wrapped around the coaxial transmission wire may be connected to the ground plane. In addition, the second radiation metal arm resonates at the third band as between 4900 MHz and 5800 MHz, in certain embodiments. The third radiation metal arm resonates at the fourth band as between 2400 MHz and 2500 MHz, according to embodiments of the present invention. The multi-band antenna structure M is not only used for wireless communication bands like GSM850, GSM900, DCS1800, PCS1900, GPS and UMTS, but also includes Wireless Local Area Network (WLAN).

Figure 6:
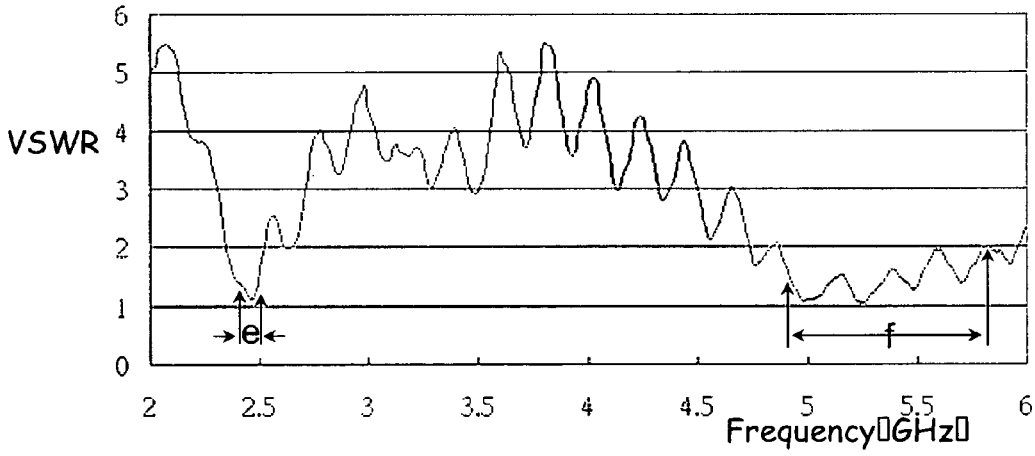
FIG. 6 is a graph illustrating performance measurement of Voltage Standing Wave Ratio (VSWR) for a multi-band antenna structure according to an embodiment of the present invention.

Referring to FIG. 6, a graph illustrates performance measurement of Voltage Standing Wave Ratio (VSWR) for a multi-band antenna structure according to an embodiment of the present invention. The VSWRs for band e from 2400 MHz to 2500 MHz and band f from 4900 MHz to 5800 MHz are minimums. Hence the bands further cover WLAN and have good antenna radiation gains.

Figure 7:
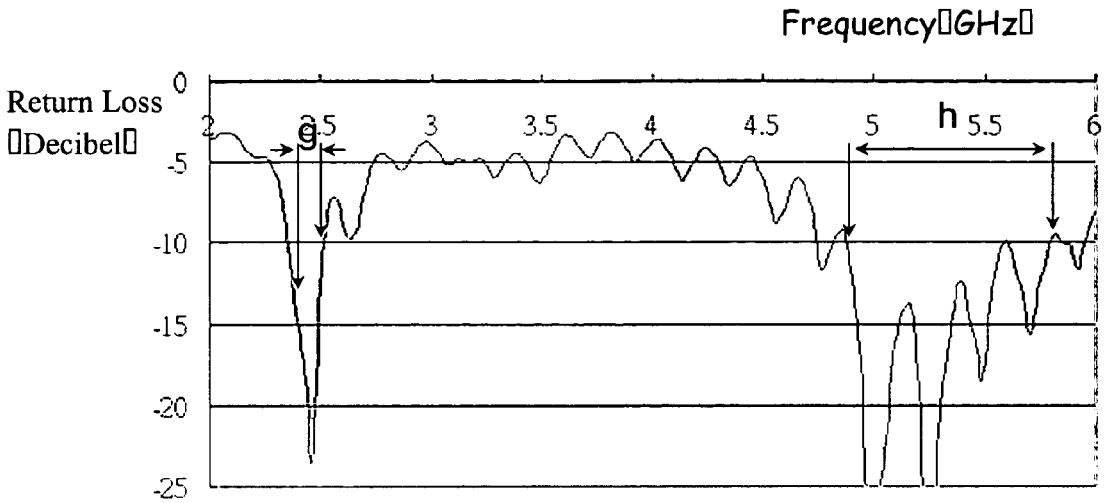
FIG. 7 is a graph illustrating the input impedance measurement for a multi-band antenna structure according to an embodiment of the present invention.

Referring to FIG. 7, a graph illustrates the input impedance measurement for a multi-band antenna structure according to an embodiment of the present invention. To observe the return loss as shown in the curve diagram, the band g from 2400 MHz to 2500 MHz and the band h from 4900 MHz to 5800 MHz are good operation bands.

Figure 8:
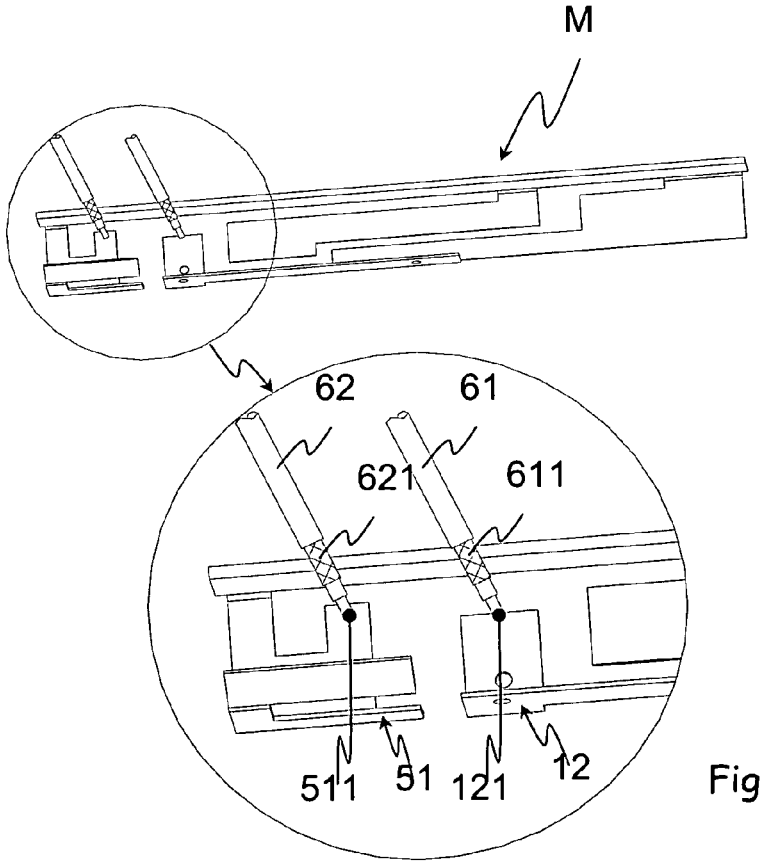
FIG. 8 is a perspective drawing illustrating a multi-band antenna structure made by metal forming process according to FIG. 5.

The multi-band antenna structure can be made to a flexible printed antenna by a metal forming process. Referring to FIG. 8, a perspective drawing illustrates a multi-band antenna structure made by metal forming process according to FIG. 5. A first feed line 61 as a coaxial transmission wire is connected to the first feed point 121 of the first radiation metal arm 12. An outer ground conductor 611 wrapped around the coaxial transmission wire is connected to the ground plane 11. A second feed line 62 as a coaxial transmission wire is connected to the second feed point 511 of the second radiation metal arm 51. An outer ground conductor 621 wrapped around the coaxial transmission wire is connected to the ground plane 11.

The multi-band antenna structure may be formed from metal, where that metal can be phosphor bronze, nickel silver, copper, beryllium copper which have good conductivity. Also, a flexible printed circuit board (FPCB), which has a copper trace on top, can be used and has been demonstrated in a preferred embodiment of the present invention.

Thus, the present invention provides a multi-band antenna structure that allows for wireless communication along multiple bands without requiring a large amount of space. The use of shorted parasitic arm achieves the desired operation of the antenna in multiple bands.

Having thus described several aspects of at least one embodiment of this invention, it is to be appreciated various alterations, modifications, and improvements will readily occur to those skilled in the art. For example, which the use of the antenna ground structure has been discussed with respect to portable computers, the present invention is applicable to any electronic device that uses an antenna, including portable and stationary communication devices.

Such alterations, modifications, and improvements are intended to be part of this disclosure, and are intended to be within the spirit and scope of the invention. Accordingly, the foregoing description and drawings are by way of example only.

The foregoing description and drawings should be considered as illustrative only of the principles of the invention. The invention may be configured in a variety of shapes and sizes and is not intended to be limited by the preferred embodiment. Numerous applications of the invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

We claim:

1. A multi-band antenna structure, comprising:

a ground plane;

a first radiation metal arm having a first feed point for connecting a first feed line;

a first shorted parasitic arm extending from the ground plane and resonantly coupled to said first radiation metal arm at a first band;

at least one second shorted parasitic metal arm extending from said ground plane and resonantly coupled to said first radiation metal arm at a second band;

a second radiation metal arm resonated at a third band, said second radiation metal arm having a second feed point for connecting a second feed line;

a third radiation metal arm resonated at a fourth band and extended from said second radiation metal arm, said second radiation metal arm being near said second feed point; and a third shorted parasitic arm connecting said second radiation metal arm and said third radiation metal arm to said ground plane.

2. The multi-band antenna structure of claim 1, wherein said first feed line is a coaxial transmission wire, and a ground conductor of said coaxial transmission wire is connected to said ground plane.

3. The multi-band antenna structure of claim 1, whereon said second feed line is a coaxial transmission wire, and a ground conductor of said coaxial transmission wire is connected to said ground plane.

4. The multi-band antenna structure of claim 1, wherein said first band is between 824 MHz and 960 MHz.

5. The multi-band antenna structure of claim 1, wherein said second band is between 1575 MHz and 2170 MHz.

6. The multi-band antenna structure of claim 1, wherein said third band is between 4900 MHz and 5800 MHz.

7. The multi-band antenna structure of claim 1, wherein said fourth band is between 2400 MHz and 2500 MHz.

8. The multi-band antenna structure of claim 1, wherein said multi-band antenna is configured to be used in a mobile communication device.

* * * * *